United States Patent [19]

Alazet

[11] Patent Number: 4,800,881

[45] Date of Patent: Jan. 31, 1989

[54] DEPILATING APPLIANCE

[75] Inventor: Jean Alazet, Paris, France

[73] Assignee: Pilus, Paris, France

[21] Appl. No.: 76,168

[22] PCT Filed: Nov. 4, 1986

[86] PCT No.: PCT/FR86/00374

§ 371 Date: Jun. 30, 1987

§ 102(e) Date: Jun. 30, 1987

[87] PCT Pub. No.: WO87/02556

PCT Pub. Date: May 7, 1987

[30] Foreign Application Priority Data

Nov. 5, 1985 [FR] France ..... 85 16350

[51] Int. Cl.[4] ..... A61B 17/00

[52] U.S. Cl. ..... 128/355

[58] Field of Search ..... 132/73.6, 75.5, 75.6, 132/73, 9; 30/43.3, 43.91, 42, 45, ; 19/2; 69/26, 20; 128/355

[56] References Cited

U.S. PATENT DOCUMENTS

| | | | |
|---|---|---|---|
| 1,667,170 | 4/1928 | Segal | 128/355 |
| 1,991,816 | 2/1935 | Moseley | 128/355 |
| 2,025,006 | 12/1935 | Ubelhart et al. | 128/355 |
| 2,123,870 | 7/1938 | Wehmer | 128/355 |
| 2,272,053 | 2/1942 | Altemus | 30/43.3 |
| 2,374,724 | 5/1945 | Belz | 30/43.3 |
| 2,413,998 | 1/1947 | Scott | 128/355 |
| 2,936,768 | 5/1960 | Chamberlain | 132/73.6 |
| 3,911,530 | 10/1975 | Kalfsbeek et al. | 69/26 |
| 4,079,741 | 3/1978 | Daar et al. | 17/47 |
| 4,171,701 | 10/1979 | Walter et al. | 128/355 |
| 4,575,902 | 3/1986 | Alazet | 19/2 |
| 4,700,476 | 10/1987 | Locke et al. | 30/43.91 |

FOREIGN PATENT DOCUMENTS

| | | | |
|---|---|---|---|
| 0147285 | 7/1985 | European Pat. Off. . | |
| 2215914 | 8/1974 | France . | |
| 2307491 | 11/1976 | France . | |
| 2334320 | 7/1977 | France . | |
| 2425822 | 12/1979 | France . | |
| 1448872 | 9/1976 | United Kingdom | 30/43.3 |

*Primary Examiner*—Paul J. Hirsch

*Attorney, Agent, or Firm*—Young & Thompson

[57] ABSTRACT

A depilating appliance comprising a pair of plucking-out jaws (5) having registering edges. The jaws comprise the ends of two arms (20) hingedly interconnected at a point intermediate their length in the fashion of the two arms of a pair of pliers. A driving member (3) is coupled to the hinged arms (20) and carries the plucking-out jaws and is adapted to impart to the arms a reciprocating movement of translation along an axis (X-Y) parallel to the registering edges of the jaws. The driving member is driven in turn by a motor housed inside a casing of the appliance. Control cams engage the ends (28) of the hinged arms (20) which are remote from the plucking-out jaws. These cams are adapted to move the jaws toward and away from each other during the translation of the hinged arms assembly in one or the other direction. The cams comprise a pair of guideways engaged each by the corresponding end (28) of one of the arms, these ends (28) being adapted to slide along the guideways when the hinged arm assembly (20) is driven for translation in one and the other direction.

4 Claims, 3 Drawing Sheets

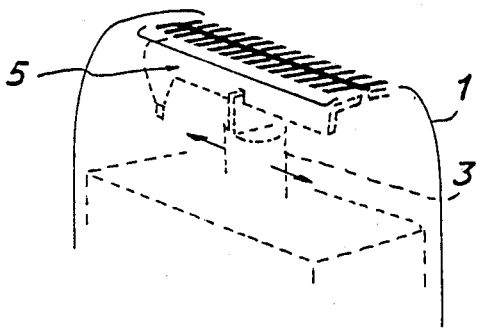
FIG_1
FIG_3
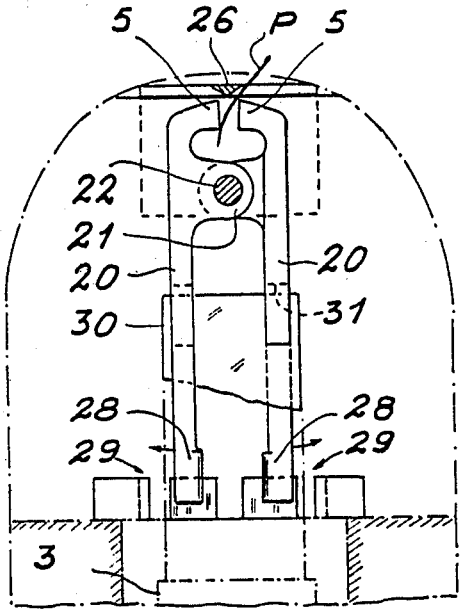
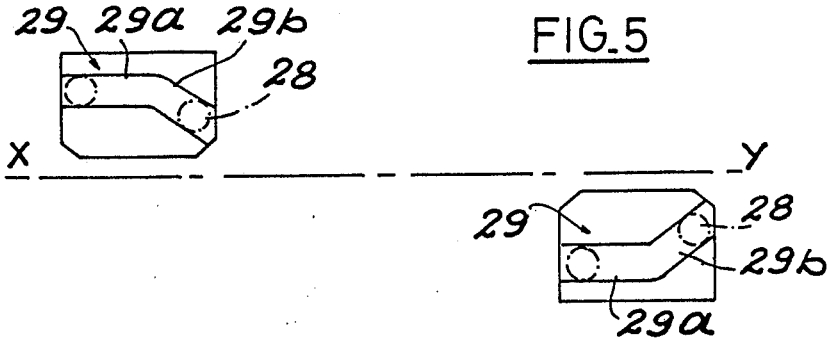
FIG_5

DEPILATING APPLIANCE

The present invention relates to depilating appliances which can be held in one hand in order to displace them on the skin for removing superfluous hairs.

A certain number of appliances of this type already exist.

Thus French patent application No. 2,307,491 describes an appliance in which two pairs of rollers rotate in opposite directions for plucking-out hairs as they engage between these latter. This appliance, however, is of limited efficiency. This is due to the nature of the elements employed for plucking hairs. These latter are in fact not gripped between the rotating rollers in a sufficiently effective manner. Furthermore, the point at which the hairs are effectively gripped between the two rollers, or in other words the point of contact between these latter, is necessarily set back to a substantial extent with respect to the corresponding end of the casing of the appliance.

There exist other depilating appliances which are also equipped with rotating rollers for plucking-out hairs, for example the appliance described in French patent application No. 2,334,320 as well as the appliance described in French patent application No. 2,425,822. However, the efficiency of these appliances is equally unsatisfactory. In addition, the cost price of these appliances is relatively high on account of the presence of the mechanisms which are necessary for driving in rotation the elements used for plucking-out hairs to be removed.

It is for these reasons that the object of the present invention is to provide a small appliance which has the same intended function but which is so designed as to offer optimum efficiency while nevertheless requiring limited capital outlay.

To this end, said appliance is essentially characterized in that the hair-plucking members provided in this latter consists of two jaws placed in oppositely-facing relation and mounted so as to be capable of moving in the same plane while being coupled with an actuating member which is capable of driving them in a reciprocating movement of translation along an axis parallel to the oppositely-facing edges of these jaws whilst guiding means carry out successive separation and clamping of these two jaws during their displacement in one direction and then in the other, the hairs trapped between the two jaws being plucked-out under the action of transverse displacement of these latter while they are maintained applied against each other.

Thus the present appliance has a working head which is of very simple design and does not have any complicated or costly mechanisms. In point of fact, the movable jaws provided in this working head can be displaced by an actuating dog which is driven in a reciprocating movement of translation by means of a mechanism of very simple design of the same type as those provided in many electric shavers. Furthermore, the working head of the present appliance alone constitutes one of the objects of the present invention since this head can be adapted to the actuating dog provided in certain appliances which already exist.

It is worthy of note that said working head has very high efficiency. I fact, the hairs to be plucked can readily engage between the two movable jaws when these latter are located in their position of relative outward withdrawal during their displacement in one direction. They are then powerfully gripped between these jaws when they are applied against each other and are then plucked-out under the tractive force exerted on them by the jaws during their movement of displacement in the opposite direction.

In an advantageous form of construction, the hair-plucking jaws are constituted by the elbowed end portions of two arms or two pairs of arms which are pivotally coupled together at an intermediate point of their length in much the same manner as the two handles of a pair of pliers and the opposite ends of which are placed in contact with stationary cams which are capable of controlling the movements of relative inward and outward displacement of the hair-plucking jaws during the movement of translation of the system in one direction and then in the other.

Under these conditions, the articulated arms which carry the clamping jaws perform the function of levers for obtaining a high clamping force with lower power consumption.

Further particular features and advantages of the present appliance will become apparent in the course of the following description. This description is given solely by way of indication with reference to the accompanying drawings, in which:

FIG. 1 is a partial view in perspective of the depilating appliance in accordance with the invention.

FIGS. 3 and 4 are views in cross-section, respectively along the lines III—III and IV—IV of FIG. 2.

FIG. 5 is a schematic overhead plan view of the cams for controlling the articulated arms which carry the hair-plucking jaws.

Figure 2:
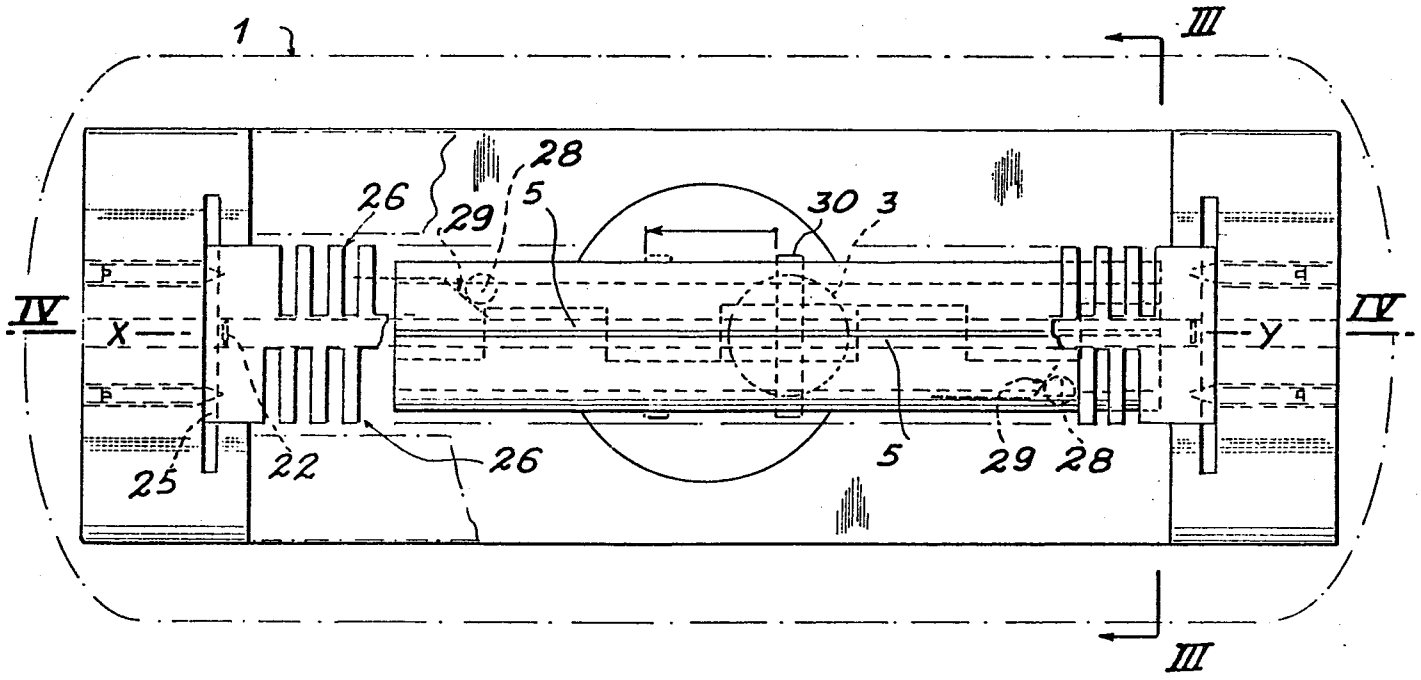
FIG. 2 is an overhead plan view of the working head of said appliance.
Figure 4:
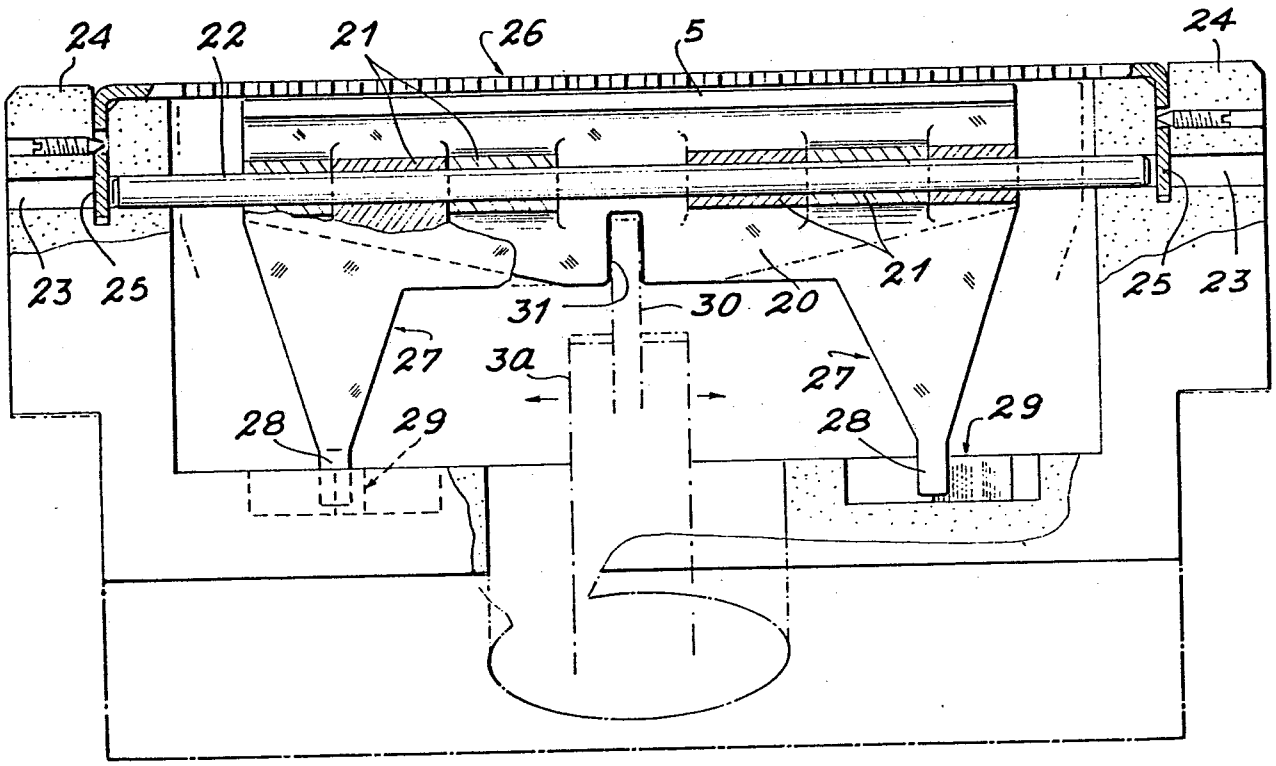

The appliance illustrated in FIGS. 1 to 5 has a small casing 1 which can be held in one hand and within which is provided an electric motor (not illustrated) supplied either through a connection to the electric current supply network or from incorporated dry cells or rechargeable storage batteries. By means of a suitable mechanism of the type provided in many electric shavers, this motor imparts a reciprocating movement of translation to an actuating arm or dog 3, the free end of which is located opposite to one end of the casing 1. This latter is provided with two movable hair-plucking jaws 5 placed in oppositely-facing relation to each other.

These jaws are constituted by the elbowed ends of two arms 20 which are pivotally coupled together at an intermediate point of their length in much the same manner as the two handles of a pair of pliers. To this end, these two arms are provided on their internal face with a series of hinge knuckles 21 within which is inserted a pivot-pin 22. The ends of this latter are engaged in bores 23 formed in the body 24 of the working head of the appliance. However, the pivot-pin 22 is held in position by the bent-back ends 25 of a protection grid 26 placed above the two hair-plucking jaws 5.

In the portion adjacent to the jaws 5, the two hinged arms 20 have a width equal to these latter. However, at their opposite ends, these two arms each have a cutout portion 27 which allows only a terminal lug 28 to remain on each of these arms. These terminal lugs are engaged within grooves 29 which are formed in the body 24 of the working head and the walls of which are capable of serving as control cams which are capable of imparting the requisite movements of pivotal displacement to the arms 20 in one direction and then in the other with a view to effecting the successive clamping and separating movements of the hair-plucking jaws 5 during the movements of translation of the moving system.

In fact, the hair-plucking jaws are coupled with the dog of an actuating device 3*a* which is driven in a movement of translation in one direction and then in the other. To this end, this actuating member carries a cross-piece 30 which is engaged within notches 31 formed in the hinged arms 20 (see FIG. 4).

Each groove 29, the walls of which perform the function of control cams, has a first rectilinear portion 29*a* which is parallel to the axis X-Y of translational displacement of the moving system and a second portion 29*b* of shorter length which is elbowed in the direction of said axis. This second portion is thus capable of causing a relative inward displacement of the terminal lugs 29 of the two hinged arms and consequently a movement of relative outward withdrawal of the clamping jaws 5. In consequence, the engagement of a hair P to be plucked-out takes place while the lugs 28 of the hinged arms travel along the elbowed portions 29*b* of the two grooves 29 in one direction and then in the other.

The hairs which have thus been caused to engage between the two clamping jaws 5 are then pulled transversely while the terminal lugs 28 of the two hinged arms are located in the portion 29*b* of the grooves 29. Now this first portion is so designed as to have a much greater length in order to ensure that the hairs trapped between the clamping jaws 5 are pulled over a sufficient distance to be plucked-out. The hairs thus removed are freed when the terminal lugs 28 return to the interior of the elbowed portions 29*b* of the two grooves 29, whereupon other hairs engage at the same time between the clamping jaws 5 for subsequent plucking-out, and so on in sequence.

The position of the hinge-pin 22 on the two articulated arms 20 is so determined that these latter are capable of performing the function of levers for multiplying the clamping force produced by the plucking jaws 5 at the time of closing of these latter. This makes it possible to obtain perfect trapping of the hairs between the two jaws 5. Furthermore, this result is obtained with lower power consumption than in the case of the first form of construction described.

However, various modifications and other forms of construction of the working head of the present appliance could be contemplated. Thus the grooves 29 which serve as cams for controlling the articulated arms could have an inclined portion 29*b* at each end. In such a case, relative outward withdrawal of the clamping jaws 5 would take place at each end of travel of the moving system in one direction and then in the other and two successive hair-plucking operations would take place respectively during displacement of the lugs 28 in one direction and then in the opposite direction.

Furthermore, instead of being constituted by the walls of the grooves 20, the control cams could consist of two protuberances against which the two terminal lugs 28 would be maintained applied, for example by means of one or a number of restoring springs provided between the arms 20. In such a case, the walls of these protuberances would be provided as in the case of the grooves 29 with a first portion of substantial length parallel to the axis X-Y and with a second portion of shorter length which is elbowed in the direction of this axis. In consequence, the functions performed by these cams would be the same as before.

Furthermore, instead of being constituted by the elbowed ends of two articulated arms 20 of substantial width, the hair-plucking jaws 5 could be carried by two pairs of articulated arms provided at their extremities, which would be mounted in the same manner as the arms 20 and also controlled by cams for producing successive inward and outward displacements of the hair-plucking jaws during the movements of translation of the moving system in one direction and in the other.

Whatever specific form of construction may be adopted, the appliance in accordance with the invention offers the advantage of being extremely effective. This is due to the basic nature of the elements employed for clamping and plucking-out hairs. In fact, these elements are constituted by two jaws which are located in immediate proximity to the skin, with the result that the hairs are gripped very close to the roots and not near their outer ends. In consequence, this effectively produces a plucking-out action on the hairs and not breaking of these latter.

Furthermore, by reason of the basic nature of the movements provided for the two clamping jaws, optimum efficiency of this appliance is achieved both in regard to clamping of the hairs to be removed and in regard to plucking-out of these latter.

However, the nature of the movements thus provided offers a further advantage in that the mechanism of the working head of the present appliance is particularly simple and inexpensive. In fact, the jaws of said working head can be displaced very simply by an actuating dog which is driven in a reciprocating movement of translation in much the same manner as the actuating dogs which exist in some electric shavers. This makes it possible in fact to construct the present appliance on the basis of certain existing elements initially manufactured for the assembly of electric shavers, the only difference being the working head. It would even be possible to construct an appliance which could serve either as an electric shaver or as a depilator by making provision for two separate and distinct removably mounted working heads, one of which could serve as a shaver and the other as a depilator in accordance with the present invention.

It is worthy of note in this connection that the working head of the present depilating appliance alone constitutes one of the objects of the present invention. This working head could in any case be marketed independently in order to be adapted to certain electric shavers or the like.

I claim:

1. Depilating appliance comprising:

a pair of plucking-out jaws (5) having longitudinal registering edges, said jaws comprising the ends of two arms (20) hingedly interconnected at a point intermediate their length in the fashion of the two arms of a pair of pliers for swinging movement about an axis parallel to said edges, a driving member (3) coupled to said hinged arms (20) provided with said plucking-out jaws and adapted to impart to said arms a reciprocating movement of translation along said axis, said driving member being driven in turn by a motor housed inside a casing of the appliance, control cams engaging the ends (28) of said hinged arms (20) which are remote from said plucking-out jaws, said cams being adapted to move said jaws toward and away from each other during said translation of said hinged arms assembly in one or the other direction, said cams comprising a pair of guideways engaged each by the corresponding end (28) of one of said arms, said ends (28) being adapted to slide along said guideways when said hinged arm assembly (20) is driven for translation in one and the other direction.

2. Depilating appliance according to claim 1, wherein said guideways comprising said cams for controlling the ends (28) of said hinged arms (20) comprise a pair of grooves (29) each engaged by the corresponding end (28) of a said hinged arm (20), each groove (29) comprising a first rectilinear section (29*a*) parallel to said axis of translational movement of said hinged arm assembly, and a shorter second section (29*b* ) inclined toward said axis and adapted to open and close said plucking-out jaws (5).

3. Operating head for a depilating appliance, which comprises an electric motor housed in a casing, and coupled with a driving member (3) to which a translational movement is imparted along an axis in one or the other direction, said operating head comprising:

a pair of plucking-out jaws (5) comprising the ends of a pair of arms (20) hingedly interconnected at a point intermediate their length, in the fashion of the two arms of a pair of pliers for swinging movement about said axis, a pair of control cams engaging respective ends (28) of said hinged arms (20) which are remote from said plucking-out jaws, said control cams controlling the movements of said plucking-out jaws toward and away from each other during the translational movement of said pair of hinged arms in one or the other direction, said control cams comprising each a pair of guideways each engaged by the corresponding end (28) of one of said arms, said end sliding along said guideway during the translational movement of said hinged arm assembly in one or the other direction.

4. Operating heading for a depilating appliance as claimed in claim 3, wherein said guideways comprising the cams controlling said hinged arms (20) comprise a pair of grooves (29) each engaged by the corresponding end (28) of one of said hinged arms (20), each groove (29) comprising a first rectilinear section (29*a*) parallel to said axis of translational movement of said hinged arm assembly and a second, shorter section (29*b*) directed toward said axis, whereby said plucking-out jaws (5) are moved toward and away from each other during the corresponding stroke of said assembly.

* * * * *